United States Patent [19]

Bates et al.

[11] Patent Number: 4,911,414

[45] Date of Patent: Mar. 27, 1990

[54] SEALING INJECTION APPARATUS FOR INJECTING SUBSTANCES INTO MOLTEN METALS

[75] Inventors: Kenneth W. Bates, Chesterfield; Peter R. Dixon, Wadsley; John G. Toyn, Chesterfield, all of England

[73] Assignee: Injectall Limited, Sheffield, England

[21] Appl. No.: 274,537

[22] PCT Filed: Apr. 8, 1988

[86] PCT No.: PCT/GB88/00272

§ 371 Date: Dec. 29, 1988

§ 102(e) Date: Dec. 29, 1988

[87] PCT Pub. No.: WO88/08040

PCT Pub. Date: Oct. 20, 1988

[30] Foreign Application Priority Data

Apr. 10, 1987 [GB] United Kingdom ..... 8708672
May 28, 1987 [GB] United Kingdom ..... 8712542

[51] Int. Cl.[4] ..... G21C 5/48
[52] U.S. Cl. ..... 266/270; 266/218
[58] Field of Search ..... 266/218, 224, 265, 266, 266/268, 270

[56] References Cited

U.S. PATENT DOCUMENTS 1,793,849 2/1931 Groninger ..... 266/270
3,971,548 7/1976 Folgero et al. ..... 266/218
4,771,992 9/1988 King ..... 266/265

FOREIGN PATENT DOCUMENTS 2339 1/1953 German Democratic Rep. .
1083600 9/1967 United Kingdom .
1170559 11/1969 United Kingdom .
2140142 11/1984 United Kingdom ..... 266/218
84/02147 6/1984 World Int. Prop. O. .
86/04928 8/1986 World Int. Prop. O. .
87/05051 8/1987 World Int. Prop. O. .
88/00246 1/1988 World Int. Prop. O. .
88/00247 1/1988 World Int. Prop. O. .

*Primary Examiner*—Robert McDowell
*Attorney, Agent, or Firm*—Buchanan Ingersoll

[57] ABSTRACT

An injection apparatus for use in injecting substances into molten metal contained in a vessel including a nozzle block having at least one initially closed injection passage and a lance movable in the passage and advanceable to open the passage for injection to commence. Sealing means is provided to establish a seal in a space between the lance pipe and the passage when the pipe is advanced to its injection position. The sealing means can include a compressible fibrous refractory sleeve fastened to the pipe adjacent an inlet end thereof. The sealing means can also comprise an array of compressible seal rings made of a compliant graphite material mounted on the pipe adjacent an inlet end of the pipe.

21 Claims, 2 Drawing Sheets

SEALING INJECTION APPARATUS FOR INJECTING SUBSTANCES INTO MOLTEN METALS

Figure 1:
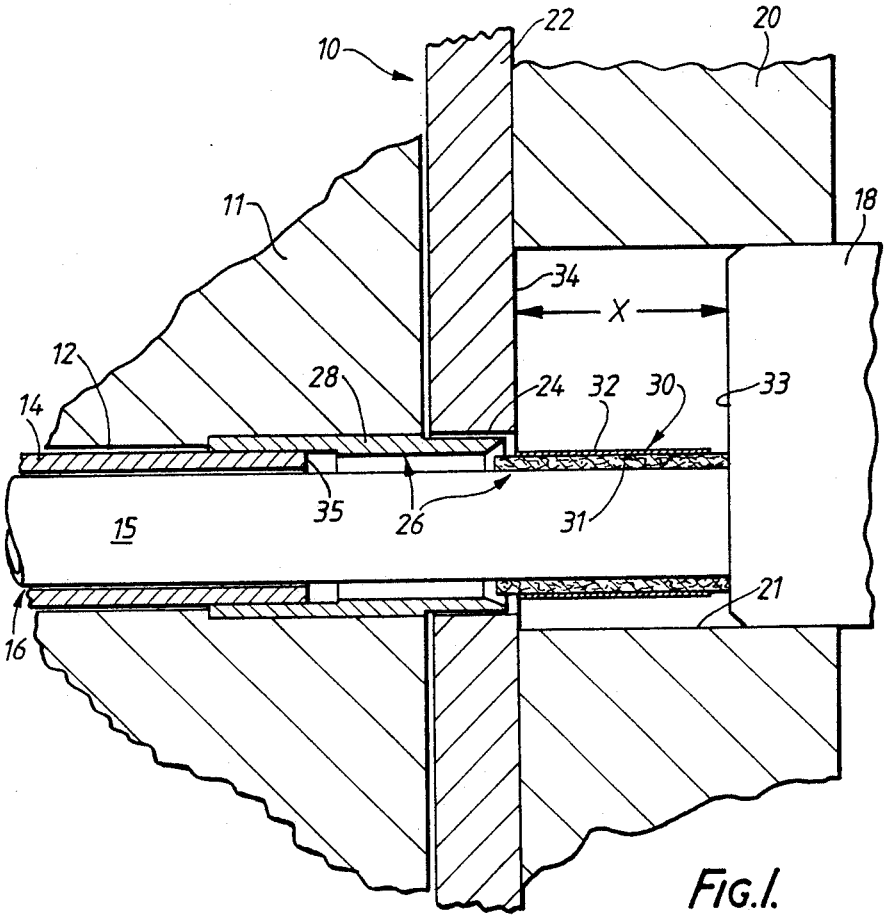

The present invention relates to sealing injection apparatus for use to inject substances into molten metals.

We have been developing apparatus and methods for introducing substances through the wall or bottom of a vessel, such as a ladle, deep into metal melt therein. Such substances include gases, powders, solids and mixtures thereof. In principle, the chosen substance is fed along a metal lance pipe loosely fitted in passage in a refractory, injection nozzle block. The loose fit permits the lance pipe to be moved forcefully along the passage, to break or dislodge a closure installed at an inner, melt end of the passage, thereby gaining access to the melt for initiating injection of the substance. See, for example, our International Patent Publication No. W084/02147, the contents of which are incorporated herein by this reference.

The loose fit also allows the pipe and passage to be flushed with a selected gas before injection commences. Generally, the gas is passed along the inside of the pipe. Before injection is started, the closure prevents the flushing gas entering the melt, so it travels back along the outside of the pipe in the clearance space in the passage, and then exhausts to the atmosphere. Besides expelling unwanted air from the passage and pipe, the flushing step permits the operator to establish the gas conditions appropriate for efficacious injection into the melt, before injection is activated. See, for instance our International Patent Publication No. WO 87/05051published on 27 Aug. 1987, the contents of which are incorporated herein by this reference.

As also disclosed in International Patent Publication No. WO 87/05051, the flushing step cools the lance pipe. Moreover, the loose fit is designed to allow the melt to penetrate and freeze in the clearance space. This is beneficial because the frozen melt locks the lance pipe in the passage and counters any tendency of the metallostatic pressure in the vessel to thrust the lance pipe outwards of the passage.

Once injection has commenced, it is desired to constrain the injection gas to enter the melt and to preclude it from escaping and exhausting to the atmosphere. To meet this desire, we provide a sealing means between the lance pipe and the outer end of the passage, operative when the lance is advanced to its injection position. An example of a sealing means is shown incidentally in FIG. 8 of the drawings of our International Patent Publication No. WO 88/00246published on 14 Jan. 1988, but is not explicitly described therein. Another example of such a sealing means is illustrated and described in our International Patent Publication No. WO 88/00247 published on 14Jan. 1988. This sealing means (35) comprises a metal sleeve (36) having a flared mouth fitted in the outer end of the passages and metal collar (38) immovably fixed on the lance pipe. A seal is attained on advancing the lance pipe when the collar and sleeve abut and interfit.

As aforesaid, melt runs back along the lance pipe, (in the clearance space). This happens apparently instantaneously upon initiating injection. Usually, the melt travels only a limited distance before freezing in the clearance space. With most metals, e.g. steel, the melt does not run back the entire length of the lance. However, we have observed that in the case of some melts, usually those that are very limpid, the run back may be very rapid and extensive. Superheated molten iron (superheat of 200°C.) is one example. This can run back as far as the sealing means. Without being bound by incompletely-understood hypothesis, we think this may be caused by the metallostatic head acting in conjunction with a pressure shock wave which may be generated in the clearance space as flushing becomes injection upon initiating injection.

If molten particles reach the sealing means, they may damage the sealing means and prevent proper sealing. Moreover, they may spray out of the passage if they reach its end before the collar has reached its sealing position. Furthermore, the injection apparatus is fabricated from a multiplicity of metallic and refractory components. The manufacturing tolerances imposed on us are such that it may not be possible easily to ensure that a proper seal is established when the lance pipe reaches the end of its forwards excursion to its injection position. Thus, there is a risk that melt could concievably spray out of the passage in unfavourable circumstances. This could be dangerous, or at least damaging to external parts of the injection apparatus.

The present invention aims to overcome some or all the problems noted in the preceding paragraph, and to provide an injection apparatus having an improved means operative between a lance pipe and an injection passage, at one or other end of the lance pipe, for effectively countering run back of melt between pipe and passage to external parts of the apparatus.

According to a first aspect of the present invention, there is provided injection apparatus for use in injecting substances into molten metal contained in a vessel, the apparatus including a nozzle block having at least one initially-closed injection passage therein, a lance pipe movable in the passage and advanceable to open the passage for injection to commence, and sealing means to establish a seal in a space between the lance pipe and the passage when the pipe is advanced to its injection position, the sealing means including a compressible fibrous refractory sleeve fastened to the pipe adjacent an inlet end thereof.

As an alternative, the first aspect of the present invention provides injection apparatus for use in injecting substances into molten metal contained in a vessel, the apparatus including a nozzle block having at least one initially-closed injection passage therein, a lance pipe movable in the passage and advanceable to open the passage for injection to commence, and sealing means which establish a seal in a space between the lance pipe and the passage when the pipe is advanced to its injection position, the sealing means including an array of compressible seal rings made of a compliant graphitic material mounted on the pipe adjacent an inlet end thereof.

According to the present invention in a second aspect, there is provided injection apparatus for use in injecting substances into molten metal contained in a vessel, the apparatus including a nozzle block having at least one initially-closed injection passage therein, a lance pipe movable in the passage and advanceable to open the passage for injection to commence, and melt-arresting means which positively limit run back of molten netal in a space between the lance pipe and the passage when the pipe has been advanced to its injection position, the melt-arresting means being located in the vicinity of the respective discharge ends of the passage and pipe.

Apparatus embodying the second aspect of the invention can be also embody either form of the first aspect of the invention. The compressible nature of the fibrous sleeve or of the seal rings accomodates manufacturing tolerances and permits an operative melt-blocking seal to be established, e.g. just before the lance pipe opens the passage for injection to commence. The materials fromm which the sleeve or rings are made are chosen for appropriate resistance to the melt.

Figure 2:
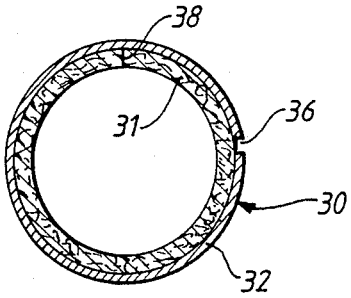
Figure 3:
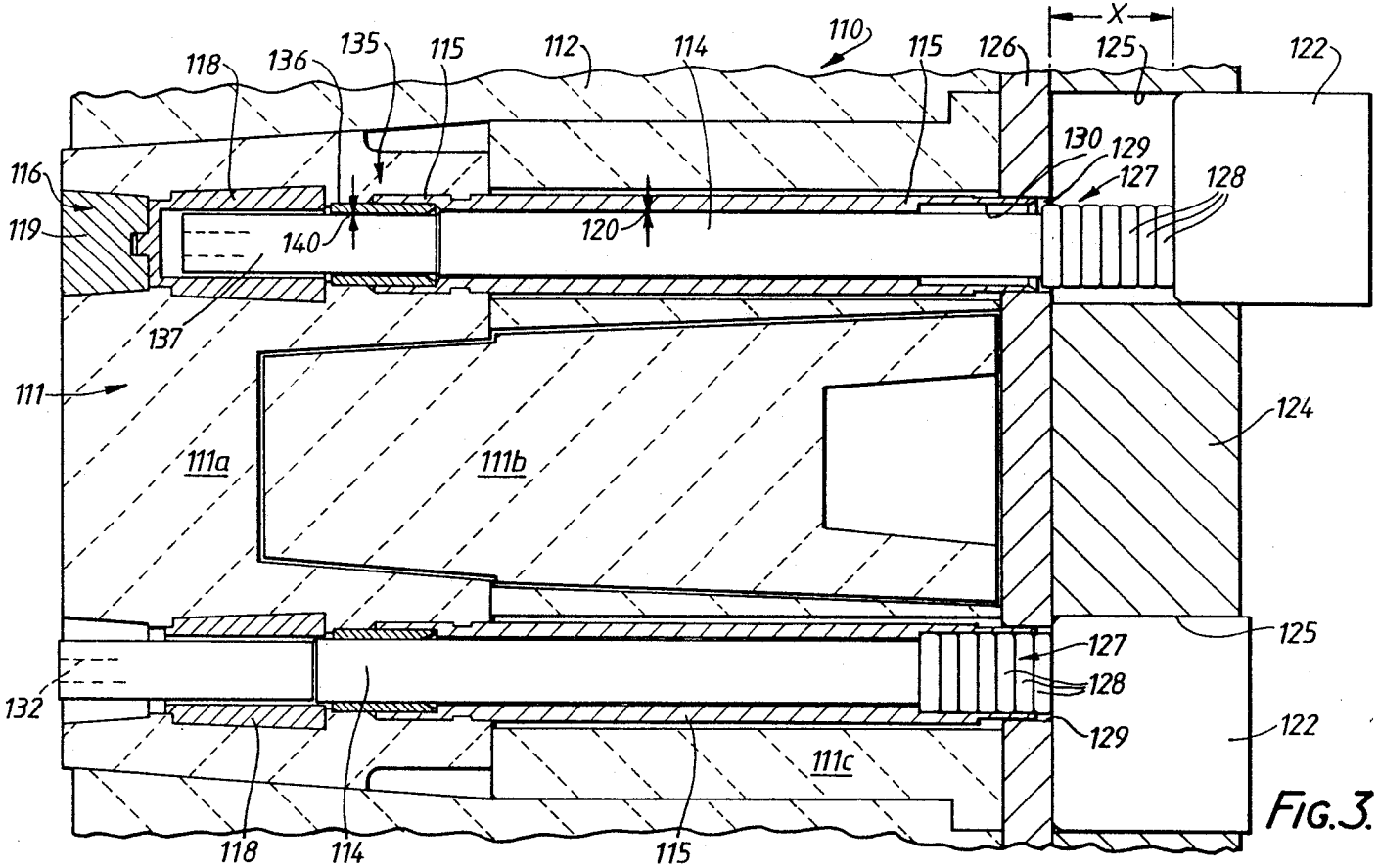

The invention will now be described by way of example only with reference to and as shown in the accompanying drawings in which:

FIG. 1 is a fragmnentary longitudinal sectional view showing, schematically, injection apparatus according to a first aspect of the present invention, FIG. 2 is a transverse sectional view of a sealing means employed according to the present invention, and FIG. 3 is a fragmentary longitudinal sectional view showing, schematically, injection apparatus according to a second aspect of the invention, this view also showing an alternative of the first aspect of the invention.

The illustrated injection apparatus is primarily meant for injecting gas, or a mixture of gas and powder deep into a metal contained in a ladle, tundish or other metallurgical vessel. The complete apparatus is not disclosed herein for simplicity, nor are its applications and method of use. For further details, the addressee's attention is drawn to our earlier patent publications referred to hereinbefore.

Injection apparatus 10 of FIGS. 1 and 2 includes an injection nozzle block 11 pierced from end to end by one or more injection passages 12. One passage is shown in the drawing, for simplicity. The nozzle block is, in use, melt-tightly installed in a wall of the melt-containment vessel. It may be located in the bottom or in a side wall of the vessel e.g. adjacent the bottom. The or each injection passage contains a movable lance pipe 15 and may optionally be lined by a guide tube 14 for the lance pipe. The tube 14 may be made from metal, refactory material e.g. alumina or from a composite of metal and refractory. The passage 11 is terminated at its inner, melt-confronting end by a temporary closure (not shown) which bars entry of melt to the passage prior to initiating an injection.

The lance pipe 15 may be a metal tube or a composite metal/refactory tube. Its outer diameter is less than the inner diameter of the passage, or the guide tube 14 if one is provided, thus permitting the lance pipe to move lengthwise and permitting flushing gas to be exhausted from the apparatus by passing outwardly along the clearance gap 16 between the passage 12 or tube 14 and the lance pipe 15. The lance pipe 15 needs to be movable, for it is used to unblock and open the passage for injection. It does this engaging the closure, to break or dislodge the latter from the melt end of the passage 12.

The outer end of the lance pipe 15 is secured to a lance head 18, which connects the pipe 15 with a duct (not shown) leading to an injectant supply. Further details of the lance head can be found in our International Patent Publication No. WO 88/00246 to which attention has been directed. The lance head 18 and lance pipe 15 are jointly movable through a predetermined excursion or stroke from a ready position to an injection position. When the pipe 15 has reached the latter position, the closure has been broken or dislodged and injection has commenced.

Movement of the lance head 18 through its excursion is guided by a location block 20. This has an accommadating pocket 21 in which the lance head 18 is slidingly movable. The location block 20 is secured to an apertured plate 22 to which other components of the apparatus may be mounted. Such other components may include means to advance the lance head 18 and pipe 15 through their operational excursion. The apertured plate 22 is rigidly affixed, directly or indirectly, to the side wall or bottom of the vessel. It has an aperture 24 coincident with the passage 12, for the lance pipe to extend from the head 18 into passage.

Means 26 are provided for creating a seal between the lance pipe 15 and the outer end of the passage 12 as the lance pipe is advanced to its sealing position. The sealing means comprises an end sleeve 28 lining the outer end of the passage 12 and a sealing collar 30 affixed to the lance pipe 15. The collar 30 telescopes into the sleeve 28 to form the seal. The sealing collar 30 comprises a fibrous refractory cylinder 31, e.g. made from REFRASIL (®) and a longitudinally slit resilient metal cylinder 32 e.g. of stainless steel. The refractory cylinder 31 is longer than the metal cylinder 32. It is also longer than the travel of the lance head 18 and pipe 15 through their operative excursion. The split metal cylinder 32 is rather shorter than the said travel. the travel is indicated by the distance X between a forward face 33 of the lance head, when this is in a preselected pre-injection position as shown, and a confronting face 34 of the apertured plate 22.

As the lance pipe 15 is advanced to its injection position, the sealing collar 30 and sleeve 28 coact to seal the clearance gap 16. Further, the refractory fibrous sleeve 30 is compressed lengthwise by abutments associated with the passage 12 and lance pipe 15. The former abutment 35 in this example is the outer end of the guide tube 14 and the latter abutment is the forward face 33 of the lance head. The distance between the abutment 35 and face 34 of the plate 22 is less than the original length of the uncompressed refractory fibrous cylinder 31. This distance is approximately the same as the travel distance X, but due to manufacturing tolerances will seldom be the same. However, these tolerances are accommadated by the fibrous sleeve 31 being longer than X and longitudinally compressible.

As fibrous sleeve 31 is compressed lengthwise, it will expand transversely, such expansion being permitted thanks to the resilient split metal cylinder 32, and will thus tightly fill the space between the end sleeve 28 and the lance pipe 15.

Early in the forward excursion of the lance pipe 15 and head 18, the fibrous sleeve 31 and metal cylinder 32 will sealingly coact with the end sleeve 28. Accordingly, escape of molten metal past the sealing means 26 is prevented at the instant the passage closure is broken or dislodged in the later part of the said excursion.

By way of example, the fibrous refractory sleeve 31 is 55mm long, while the travel of the lance pipe 15 and head 18 is 50 mm. The sleeve 31 can be 33 mm I.D. and can have a wall thickness of 3 mm, while split cylinder can have a length of 45 mm, an O.D. of 34.9 mm and a wall thickness of 1.6 mm. The slit therein, indicated by numeral 36, can be 2 mm wide. The end sleeve 28 may have a nominal bore of 32 mm to accommadate the composite collar 30 in a state of compression.

The fibrous sleeve 31 can be made from sheet material by vacuum forming around a former. So made it will have a "seam" 38. The presence of this seam will be of no consequence so far as concerns sealing, because the sleeve 32 is tightly compressed as it enters the end sleeve 28. The sleeve 31 could, of course be of seamless form.

The material from which the sleeve 31 is made can include a binder, to help the sleeve withstand the blast of gas which exhausts past the sleeve to the atmosphere before injection is initiated.

It will be appreciated that thanks to the fibrous sealing sleeve 31 being appreciably longer initially than the space it is to seal, dimensional variations in the assembly can be amply tolerated.

Referring now to FIG. 3, there is shown an injection apparatus 110 which includes an injection nozzle block structure 111, an injection passage, two being shown by way of illustration. The nozzle block structure is again melt-tightly installed e.g. by cement in the bottom or side wall 112 of the melt-containment vessel. Structure 111 is preferably made from a refractory concrete castable. Optionally the or each injection passage is defined in part by a guide tube 115 for the lance pipe 114. The pipe 114 and tube 115 again are made of metal, refractory or composite metal/refractory materials. The passage is here shown terminated at its inner, melt-confronting end by a temporary closure 116 which bars entry of melt to the passage prior to initiating an injection.

As shown, the nozzle block structure 111 comprises an assembly of interfitting refractory components 111*a*, 111*b* and 111*c* for ease of handling and installation in the vessel wall 112. The structure 111 could however be unitary refractory piece, although it would be a substantial weight.

The temporary closure 116 in the illustrated example comprises two elements 118 and 119. The first is a dense refractory cup-shaped shell 118 closed at its end closer to the vessel interior. The shell defines a portion of the downstream end of the passage. the shell 118 is embedded or cemented into the inner end of the nozzle block structure 111. It is backed up by the second element 119 which is a tapered refractory, e.g. fireclay, plug dislodgeably received in the inner end of block structure 111. The closed end of the shell 118 is made seperable from the remainder thereof by weakening the shell locally to its closed end. The purpose of this weakening is to enable the the said end to be broken away when the movable lance 114 is forcibly thrust towards the interior of the vessel. When the lance 114 is thus advanced, the shell is broken and the plug 119 is dislodged. Thereby, the lance 114 gains access to the metal in the vessel for injection to commence. The temporary closure 116 is disclosed in further detail in our International Patent Publication No. WO 88/00247.

The upper lance 114 as viewed in FIG. 3 is shown in a pre-injection position and the other lance is shown in an injection or post-injection position.

As in the first described embodiment the or each lance pipe 114 will again have an outer diameter less than the inner diameter of the major part of the passage-defining tube 115, thus permitting the the lance pipe to be moved lengthwise and permitting flushing gas to pass along the clearance gap 120 between the lance 114 and tube 115.

The outer end of each lance pipe 114 is again secured to a lance head 122, which connects the former with a duct leading to an injectant supply. Again, as described above, the lance head 122 is movable in an accommodating pocket 125 in a location block 124, in which pocket the lance head 122 is snugly received and slidingly movable. The location block 124 is secured as before to a plate 126 apertured at 129 in registry with the or each passage.

Means 127 are provided for creating a seal between the lance pipe 114 and the outer end of the passage-defining tube 115 as the lance pipe is advanced to its sealing position. The sealing means 127 comprises an array of seal rings 128 placed on the lance pipe 114, and each made of a compressible, compliant graphitic material. The array of rings telescopes into an enlarged throat 130 in the outer end of tube 115, and the seal is formed when the lance has been so advanced as to squeeze the ring array between the bottom or inner end the throat 130 and a confronting face of the lance head 122. The array of rings is longer than the travel X of the lance head 122 and pipe 114 through their operative excursion, so that the rings will be properly compressed between the bottom of the throat 130 and the head 122. When so compressed, the rings expand laterally against the inside of throat 130and against the lance 114, filling the gap therebetween and creating a gas-tight seal. The length of the array 127 can be contrived (by use of an appropriate number of rings) to be such that a seal is established just before the lance 114 actually opens the passage.

Suitable graphitic rings are not wetted or rendered porous by the melt and e.g. are available commercially from Flexitallic Limited.

As the lance pipe 114 is advanced, the array 127 of resilient graphitic rings 128 will seal the said clearance gap as the array is compressed lengthwise by abutments associated with the tube 115 and lance pipe 114. The former abutment is the bottom end of the throat 130 and the latter abutment is the forward face of the lance head 122.

By establishing the seal before the closure 116 is removed, escape of molten metal past the array of sealing rings 128 is positively prevented at the instant the closure is removed in the terminal later part of the advancement of the lance pipe.

By way of example, the array of rings 128 before it is compressed longitudinally may be 52 to 55 mm long, while the travel of the lance pipe 114 and head 122 is 50 mm.

It will be appreciated that thanks to the ring array 127 being compressible and longer initially than the space it is to seal, dimensional variations in the assembly can be amply tolerated and the seal can be established before the passage is opened for injection.

As has been indicated hereinbefore, gas is intentionally flowed under pressure along (i.e. normally through) the lance pipe 114 before commencing injection, and is then allowed to exhaust to the atmosphere. The exhaust route is the substantially annular clearance space 120 between the pipe 114 and tube 115. Before advancing the lance pipe 114, gas can escape from space 120 since the seal has yet to be provided by the ring array 127. Nowhere along the pipe 114 should the flow cross section of the clearance space be significantly smaller than the flow cross section of the passage 132 inside the pipe 114, to avoid excessively impeding the exhausting gas and creating pressure rises inside the apparatus 110 to levels above that for which the apparatus has been designed.

By way of example, passage 132 is circular with an area of 78.54 $mm^2$, and the radial clearance between pipe 114 and tube 115 along most of their respective lengths is 0.85 mm. In an apparatus according to this invention, this radial clearance gives a clearance cross section of 74.37 mm. Whilst this area is less than the flow area of passage 132, the difference is too small to create any significant problems in exhausting the gas.

In partical terms, a radial clearance sufficiently large for properly exhausting the gas, and of the order of the dimensions indicated above, is large enough to allow some melts possibly to run back along the length of the lance pipe 114 at about the instant the closure 116 is broken and ejected. The embodiment of FIG. 3 is designed to prevent such run back.

To this intent, melt-arresting means 135 is provided in the vicinity of the downstream end of the injection passage. The melt-arresting means 135 comprises a localised restriction of the clearance between the injection passage and the lance pipe 114 when the latter is advanced. In this example, the restriction is provided by an inset sleeve 136 provided in a downstream end of the tube 115.

As shown, the pipe 114 has a reduced diameter extent 137 leading to its discharge end. Further, it will be noted that before the lance 114 is advanced to commence injection, this reduction-sized part 137 is located inside the sleeve 136 and extents through the entire length thereof. The radial clearance 140 betwen lance part 137 and sleeve 136 is, by way of example 1 mm, giving-a clearance area of 81.68mm in the particulat apparatus designed according to this invention. This clearance area exceeds the areaa of the passage 132, so it provides no significant restriction to the exhaust of gas.

When the lance is advanced, and shortly before it breaks and ejects the closure 116, the larger main part of the lance pipe 114 enters the inset sleeve 136. The diameter of the larger part is only marginally smaller than the inner diameter of the sleeve 136. The difference in diameter, or radial clearance, is such as to allow the lance to move longitudinally in the sleeve, but is too small for melt to run back to any significant extent beyond he sleeve 136. The difference in diameter is, for example 0.1 mm. By way of example, the diameter of the larger main part of the lance pipe 114 is 26.9 mm–0.05 mm while the I.D. of the sleeve 136 is 27 mm+0.05 mm, giving a radial clearance of 0.1 mm maximum and 0.05 minimum.

Due to this very small clearance, at commencement of injection run back of melt will be effectively arrested or decelerated to an extent that it may become frozen or at least pasty in the clearance between sleeve 136 and lance pipe 114. The clearance will almost instantaneously block run-back of melt in the outward direction.

The very small clearance between sleeve 136 and the main extent of the pipe allows for only very minor departures from concentricity betweeen it and the main part of the lance pipe. It is thought that substantial centricity failings could lead to potentially dangerous or damaging run back of melt.

In the excedingly unlikely event of melt running back past the sleeve, the array 127 of sealing rings 128 will positively prevent escape of melt from the injection passage.

The dimensions quoted hereinbefore are by way of example only and they relate to a specific apparatus. Such dimensions may be varied depending inter alia upon the specific design and size of apparatus, and the operational conditions it will face. What is critical in this aspect of the invention is that a restricted clearance between the lance pipe 14 and the injection pasage is established immediately before the passage is opened for injection to commence, the clearance being such as to permit continued advancing of the lance pipe and to decelerate or arrest run back of melt. Given the example herein, plus routine experiment, the ordinarily skilled addressee will be able to select restricted clearances possessing the required criteria.

The design of the restriction can, of course, be varied and need not be as shown in FIG. 3. For example, the lance pipe could have an enlargement at or set back fromnits discharge end, and the passage or guide tube (where provided) could have an internal recess positioned to encompass the enlargement before the lance is advanced. The recess would provide a clearance affording free flow of flushing gas around the enlargement. The enlargement would be a close fit in the unrecessed portion downstream of the recess when the pipe is advanced for initiating injection, so as to serve as the melt-arresting means. A sleeve affixed to the lance pipe could constitute the enlargement.

The inventive features disclosed hereinbefore are the melt-arresting means and the fibrous sleeve or the array of compliant graphitic seal rings. These features can be used seperately as well as in conjunction.

INDUSTRIAL APPLICABILITY

The injection apparatus disclosed herein is applicable to the introduction of gases, or gases plus powders, into molten metals comntained in vessels such as ladles. The molten metals can be ferrous or non-ferrous, and the injectants can be employed to achieve thermal and/or compositional uniformity of the melt before it is poured from the ladle, or to change its chemical composition.

We claim:

1. Injection apparatus for use in injecting substances into molten metal contained in a vessel, the apparatus comprising a nozzle block having at least one initially-closed injection passage therein, a lance pipe movable in the passage and advanceable to open the passage for injection to commence, and melt-arresting means which limit run back of molten metal in a space between the lance pipe and the passage when the pipe has been advanced to its injection position, the melt-arresting means being located in the vicinity of the respective discharge ends of the passage and pipe.

2. Apparatus according to claim 1, wherein the said space provides a flow path for unrestricted exhaust of flushing gas prior to advancement of the lance pipe to its injection position.

3. Apparatus according to claim 2, wherein the said space has a flow cross section slightly smaller than the flow cross section of a gas duct provided inside the lance pipe.

4. Apparatus according to claim 1, wherein the melt-arresting means comprises portions of the pipe and passage which coact, when the pipe is advanced to its injection position, to provide a restricted clearance which allows movement of the pipe but is too small for any significant flow of molten metal.

5. Apparatus according to claim 4, wherein a construction at or adjacent an end of the passage, adajcent a discharge end of the nozzle block, coacts with the outer surface of the lance pipe to provide the restricted clearance.

6. Apparatus according to claim 5, wherein a reduced diameter end portion of the pipe is located in the construction before the pipe is advanced, the reduced diameter affording a clearance for free exhaust of flushing gas, and when the pipe is advanced, a larger portion thereof is moved into the construction to establish the said restricted clearance.

7. Apparatus according to claim 1, wherein the lance pipe carries an array of compressible seal rings made of a compliant graphitic material, for sealing a space between the pipe and the passage at their respective ends remote from the discharge end of the nozzle block.

8. Injection apparatus for use in injecting substances into molten metal contained in a vessel, the apparatus including a nozzle block having at least one initially-closed injection passage therein, a lance pipe movable in the passage and advanceable to open the passage for injection to commence, and sealing means which establish a seal in a space between the lance pipe and the passage when the pipe is advanced to its injection position, the sealing means including an array of compressible seal rings made of a compliant graphitic material mounted on the pipe adjacent an inlet end thereof.

9. Apparatus according to claim 8, wherein the sealing means forms a seal in an enlarged annular space located at an end of the passage around the inlet end of the pipe when the pipe is advanced.

10. Apparatus according to claim 8, wherein the array of rings is longitudinally compressible between confronting abutments respectively associated with the passage and the lance pipe.

11. Apparatus according to claim 10, wherein the pipe is movable through an excursion when advanced to open the passage for injection, and when advanced its abutment is closer to the other abutment than the initial length of the array of rings whereby the array is compressed longitudinally and is caused to expand transversely tightly to seal the said enlarged space.

12. Injection apparatus for use in injecting substances into molten metal contained in a vessel, the apparatus including a nozzle block having at least one initially-closed injection passage therein, a lance pipe movable in the passage and advanceable to open the passage for injection to commence, and sealing means to establish a seal in a space between the lance pipe and the passage when the pipe is advanced to its injection position, the sealing means including a compressible fibrous refractory sleeve fastened to the pipe adjacent an inlet end thereof.

13. Apparatus according to claim 12, wherein the sealing means form a seal in an enlarged annular space located at an end of the passage around the pipe when the pipe advanced.

14. An expandable lance pipe for use in injecting substances into molten metal, the pipe having a fibrous refractory sealing sleeve clamped thereto adjacent one end thereof by a resilient metal clamping element, and the sleeve being compressible in its lengthwise dimension.

15. A lance pipe according to claim 14, which has an extent of reduced diameter leading to the end of the pipe remote from the sealing sleeve.

16. A lance pipe according to claim 14, wherein the clamping element is a slit cylindrical collar shorter than the fibrous sealing sleeve, the latter having boths its opposite ends projecting beyond the slit collar.

17. An expandable lance pipe for used in injecting substances into molten metal, the pipe having array of compressible seal rings fitted thereto in use when compressed to establish a seal adjacent one end of the pipe, each of said seal rings being made of a compliant graphitic material.

18. A lance pipe according to claim 17, which has an extent of reduced diameter leading to the end of the pipe remote fro the seal rings.

19. Injection apparatus for use in injecting substances into molten metal contained in a vessel, the apparatus including a nozzle block having at least one initially-closed injection passage therein, a lance pipe movable in the passage and advanceable to open the passage for injection to commence, and sealing means to establish a seal in a space between the lance pipe and the passage when the pipe is advanced to its injection positon, the sealing means including a compressible fibrous refractory sleeve fastened to the pipe adajcent an inlet end thereof, said fibrous sleeve being located between confronting abutments respectively associated with the passage and the lance pipe, said fibrous sleeve being compressed longitudinally betwen these abutments when the lance pipe is advanced.

20. Injection apparatus for use in injecting substances into molten metal contained in a vessel, the apparatus including a nozzle block having at least one initially-closed injection passage therein, a lance pipe movavble in the passage and advanceable to open the passage for injection to commence, and sealing means to establish a seal in a space between the lance pipe and the passage when the pipe is advanced to its injection positon, the sealing means including a compressible fibrous refractory sleeve fastened to the pipe adjacent an inlet end thereof, said fibrous sleeve being located between confronting abutments respectively associated with the passage and the lance pipe, said fibrous sleeve being compressed longitudinally between these abutments when the lance pipe is advanced, said pipe being movable through an excursion when advanced to open the passage for injection and when advanced its abutment is closer to the other abutment than the initial length of the fibrous sealing sleeve whereby the sleeve is compressed longitudinally and is caused to expand transversely tightly to seal space.

21. Injection apparatus for use in injecting substances into molten metal contained in a vessel, the apparatus including a nozzle block having at least one initially-closed injection passage therein, a lance pipe movable in the passage and advanceable to open the passage for injection to commence, and sealing means to establish a seal in a space between the lance pipe and the passage when the pipe is advanced to its injection position, the sealing means including a compressible fibrous refractory sleeve fastened to the pipe adajcent an inlet end thereof, said fibrous sealing sleeve being clamped to the lance pipe by a resilient slit metal cylinder.

* * * * *

UNITED STATES PATENT AND TRADEMARK OFFICE

CERTIFICATE OF CORRECTION

PATENT NO. : 4,911,414

DATED : March 27, 1990

INVENTOR(S) : KENNETH W. BATES, PETER R. DIXON, JOHN G. TOYN

It is certified that error appears in the above-identified patent and that said Letters Patent is hereby corrected as shown below:

Column 1, line 14, after "in" insert --a--. (First Occur.)

Column 1, line 53, change "88/00246published" to --88/00246 published--.

Column 1, line 57, change "14Jan." to --14 Jan.--.

Column 1, line 59, after "and" insert--a--.

Column 2, line 66, change "netal" to --metal--.

Column 3, line 10, change "fromm" to --from--.

Column 3, line 27, after "metal" insert --melt--.

Column 4, line 14, after "into" insert --the--.

Column 4, line 23, change "( R )" to --(RTM)--.

Column 6, line 17, after "end" insert --of--.

Column 6, line 24, change "130and" to --130 and--.

Column 7, line 44, change "he" to --the--.

Column 8, line 16, change "fromnits" to --from its--.

Column 8, claim 5, lines 66-67, change "construction" to --constriction--.

UNITED STATES PATENT AND TRADEMARK OFFICE

CERTIFICATE OF CORRECTION

PATENT NO. : 4,911,414

DATED : March 27, 1990

INVENTOR(S) : KENNETH W. BATES, PETER R. DIXON, JOHN G. TOYN

It is certified that error appears in the above-identified patent and that said Letters Patent is hereby corrected as shown below:

Column 9, lines 4-5, claim 6, change "construction" to --constriction--.

Column 9, line 7, after "larger" insert --diameter--.

Column 9, line 9, change "construction" to --constriction--.

Column 9, line 57, claim 13, change "form" to --forms--.

Column 10, line 9, claim 17, after "having" insert --an--.

Column 10, line 16, claim 18, change "fro" to --from--.

Column 10, line 52, claim 20, after "seal" insert --said--.

Signed and Sealed this

Thirtieth Day of July, 1991

*Attest:*

*Attesting Officer*

HARRY F. MANBECK, JR.

*Commissioner of Patents and Trademarks*